US009535448B2

(12) United States Patent
Key

(10) Patent No.: US 9,535,448 B2
(45) Date of Patent: Jan. 3, 2017

(54) CHROMATIC MAINFRAME

(76) Inventor: Jean-Pierre Key, Aiken, SC (US)

( * ) Notice: Subject to any disclaimer, the term of this patent is extended or adjusted under 35 U.S.C. 154(b) by 1103 days.

(21) Appl. No.: 13/297,527

(22) Filed: Nov. 16, 2011

(65) Prior Publication Data

US 2013/0124115 A1 May 16, 2013

(51) Int. Cl.
*G06E 1/00* (2006.01)

(52) U.S. Cl.
CPC ..... *G06E 1/00* (2013.01)

(58) Field of Classification Search
CPC ..... H01L 2924/00
USPC ..... 702/57
See application file for complete search history.

(56) References Cited

U.S. PATENT DOCUMENTS 4,093,991 A * 6/1978 Christie et al. ..... 356/319
4,184,202 A 1/1980 McCrae
4,382,660 A * 5/1983 Pratt et al. ..... 359/244
4,438,491 A 3/1984 Constant
4,449,821 A 5/1984 Lee
4,948,959 A 8/1990 Houk
5,182,666 A 1/1993 Kawabe
5,249,144 A 9/1993 Falk
5,408,548 A 4/1995 Olmstead
5,498,863 A * 3/1996 Miller ..... 250/214.1
6,151,428 A * 11/2000 Vahala et al. ..... 385/11
6,178,020 B1 1/2001 Schultz
6,381,059 B1 * 4/2002 Carlson ..... G02B 26/02 252/582
6,718,012 B2 * 4/2004 Ein-Gal ..... 378/121
7,605,823 B2 10/2009 Stokes
7,792,357 B2 9/2010 Kang
8,308,318 B2 * 11/2012 Maxik ..... F21S 2/00 362/153.1
2002/0027703 A1 * 3/2002 Kinoshita et al. ..... 359/337.1
2002/0051284 A1 * 5/2002 Takatsu ..... G06F 12/0866 359/341.1
2002/0070681 A1 * 6/2002 Shimizu ..... H01L 25/0753 315/246
2003/0053785 A1 3/2003 Ho
2004/0268080 A1 12/2004 Ohba
2005/0127833 A1 * 6/2005 Tieszen ..... H01L 33/56 313/512
2006/0014302 A1 1/2006 Martinez
2007/0045524 A1 * 3/2007 Rains, Jr. ..... F21K 9/00 250/228

(Continued)

OTHER PUBLICATIONS

Symon D'O. Cotton, Colour, Coulour Spaces and the Human Visual System, May 1, 1995, University of Birmingham.*

(Continued)

*Primary Examiner* — Manuel L Barbee
*Assistant Examiner* — Raymond Nimox
(74) *Attorney, Agent, or Firm* — Marin Cionca; CIONCA Law Group P.C.

(57) ABSTRACT

A chromatic processor and a computational process which includes the steps of assigning values to wavelengths of a portion of the electromagnetic spectrum; using electromagnetic emitters for emitting waves having some of those wavelengths; expanding the number of waves available to the computational process by controlling the electromagnetic emitters input to a blended wave output; and combining some of the available waves in order to obtain new wave(s) representing new value(s).

19 Claims, 11 Drawing Sheets

(56) References Cited

U.S. PATENT DOCUMENTS

| | | | | |
|---|---|---|---|---|
| 2007/0051881 | A1* | 3/2007 | Ashdown | G01J 3/10 250/226 |
| 2007/0194679 | A1* | 8/2007 | Jo | H01J 11/10 313/112 |
| 2007/0235751 | A1* | 10/2007 | Radkov | C09K 11/7734 257/103 |
| 2008/0106186 | A1* | 5/2008 | Ishii | C09K 11/7734 313/503 |
| 2008/0238829 | A1* | 10/2008 | Kane | H01L 27/3213 345/76 |
| 2009/0219305 | A1 | 9/2009 | Diederiks | |
| 2010/0002440 | A1* | 1/2010 | Negley | F21K 9/00 362/249.14 |
| 2010/0090935 | A1* | 4/2010 | Tseng | C09K 11/7721 345/83 |
| 2013/0062639 | A1* | 3/2013 | Doan | H01L 33/50 257/98 |

OTHER PUBLICATIONS

Non-Silicon Non-Binary Computing: Why Not?—http://citeseerx.ist.psu.edu/viewdoc/summary?doi=10.1.1.11.7716.

Ditching Binary will Make Quantum Computers More Powerful—http://www.newscientist.com/article/dn17575-ditching-binary-will-make-quantum-computersmore-powerful.html.

Binary vs. Non-Binary Constraints—http://www.cs.uwaterloo.ca/~vanbeek/Publications/ai02.pdf.

* cited by examiner

| *COLOR LEGEND* | |
|---|---|
| | Violet or Purple |
| | Blue |
| | Green |
| | Yellow |
| | Orange |
| | Red |
| | Brown |
| | Black |
| | Magenta |
| C | Cyan |
| P | Pink |
| | White |

FIG. 1b

CHROMATIC MAINFRAME

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

1. Field of the Invention

The invention relates generally to the field of computing and processing, and particularly, to methods and system for using electromagnetic waves for performing mathematical and logical operations.

2. Description of the Related Art

State of the art data processing and computational technologies have been enabled by the advances made in electronics, leading to increasing speed and power of digital computers. However, serious problems exist. First, power consumption and heating rise due to rising clock frequencies. Secondly, the strides made in the processor technology are becoming increasingly redundant as more bottlenecks are being reached due to the disparity between processing units and memory. Thus, there is a need for a new process and system for mathematical and logical computation that increases computational power while consuming less electricity, emitting less heat and allowing for more data to be processed in a single cycle.

BRIEF SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In one exemplary embodiment a new process for mathematical and logical computation is provided. Electromagnetic emitters, replacing the binary computation of previous computers, may expand the power of a computational device as each "channel" or wavelength could be used to represent information rather than electrical circuit switches being on or off (i.e., ground and voltage), commonly referred to as "zeroes and ones." Using this model and various techniques combined together, may be used to solve the main issues stunting the growth of computational technology today. By removing some of the electrical components, this process provides a solution to power consumption and heating problem. This is because objects such as busses would need to transfer light instead of current. Such buses would be now fiber optics for example.

In addition, with this method and system, given the variability of the electromagnetic spectrum, a greater computational power, than that of existing integrated circuit based systems, may be achieved.

The above embodiments and advantages, as well as other embodiments and advantages, will become apparent from the ensuing description and accompanying drawings.

BRIEF DESCRIPTION OF THE DRAWINGS

For exemplification purposes, and not for limitation purposes, embodiments of the invention are illustrated in the figures of the accompanying drawings, in which:

FIG 1*b* is depicting a color legend.

FIG. 8-*b* depicts a RGB LED under the influence of an analog or digital signal.

DETAILED DESCRIPTION OF THE PREFERRED EMBODIMENTS

Figure 1A:
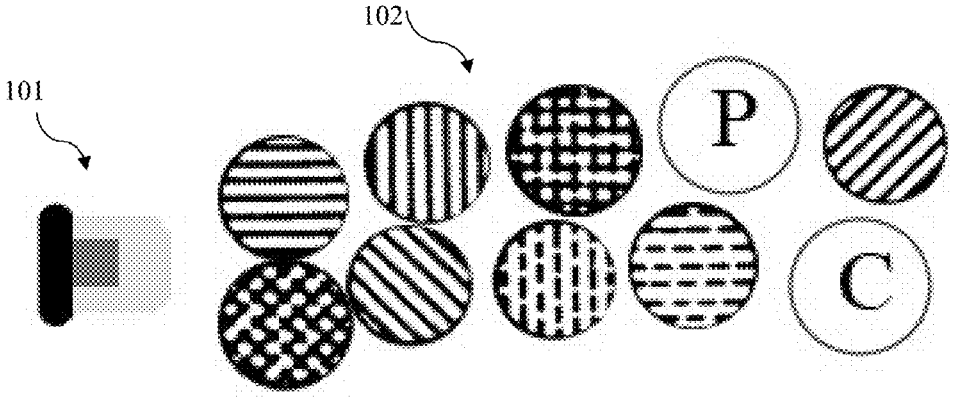
FIG. 1*a* is depicting a red, green, and blue ("RGB") light-emitting diode ("LED") emitting a spectrum of colors.

What follows is a detailed description of the preferred embodiments of the invention in which the invention may be practiced. Reference will be made to the attached drawings, and the information included in the drawings is part of this detailed description. The specific preferred embodiments of the invention, which will be described herein, are presented for exemplification purposes, and not for limitation purposes. It should be understood that structural and/or logical modifications could be made by someone of ordinary skills in the art without departing from the scope of the invention. Therefore, the scope of the invention is defined by the accompanying claims and their equivalents.

FIG. 1*a* is depicting a red, green, and blue ("RGB") light-emitting diode 101 ("LED") emitting a spectrum of colors 102. FIG. 1*b* is depicting a color legend. The LED 101 is an example of electromagnetic emitters which may be used to implement the chromatic computing method and system described herein. However, other electromagnetic radiation emitting devices may be used (e.g., organic LED). Also, while a visible spectrum 102 is depicted in FIG. 1*a*, invisible electromagnetic waves may be used as well to implement this method. As described later herein, methods, using components such as variable resistors (potentiometers), timers, and microprocessors, may be used, through analog or digital means, to change the intensity of a wave, by changing the current running through the diode, or the time (cycle) at which the emitter is on or off. By changing the intensity of a wave, its influence on a wave blend is also changing. Thus, a larger number of wave blend outputs may be obtained using the same number of waves as inputs, by simply manipulating the intensity of the input waves.

Figure 2A:
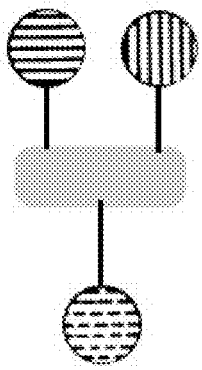
FIGS. 2*a-e* illustrate five exemplary ways of changing the wavelength of colors.
Figure 2B:
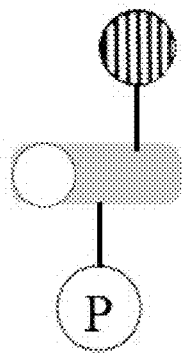
Figure 2C:
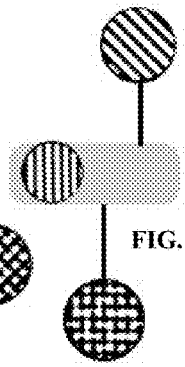
Figure 2D:
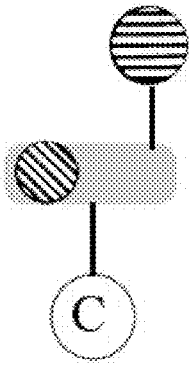
Figure 2E:
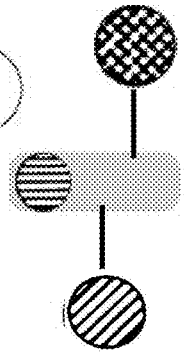

FIGS. 2*a-e* illustrate five exemplary techniques of changing the wavelength of colors: by "color combining" (FIG. 2*a*), saturation (add white; FIG. 2*b*), and/or red, green and blue "shifting," FIGS. 2*c,d,e*, respectively. When used together one can add or subtract values, which is the basis of computing: "solving" problems as logical/mathematical equations.

Figure 2F:
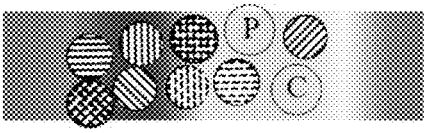
FIGS. 2*f* and 2*g* illustrate the visible spectrum and primary colors combinations, respectively.
Figure 2G:
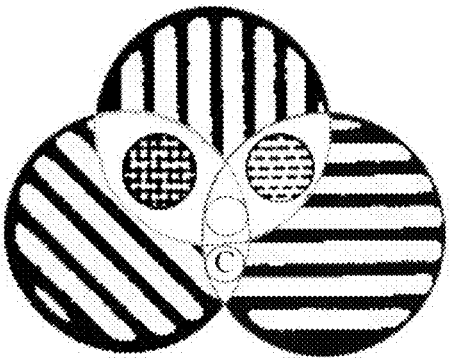

FIGS. 2*f* and 2*g* illustrate the visible spectrum and primary colors combinations, respectively. The range in the visible part of the electromagnetic spectrum benefits the most from the computational process disclosed herein. Visible light is normally broken up into seven distinct colors or wavelengths: red, orange, yellow, green, blue, indigo and violet. However, three of them (red, green, and blue) can be superimposed and/or diffused (blended) to create cyan, magenta, yellow or white light (i.e., all visible colors mixed). Furthermore, by applying the techniques disclosed herein, to the seven distinct colors, millions of colors could be described.

Figure 3A:
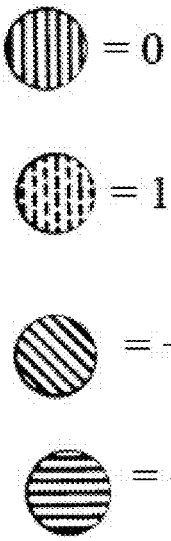
FIGS. 3*a-b* illustrate an example of a "quantum" like way of processing in which electromagnetic waves are interchangeable with binary expressions and represent units of data or operations.
Figure 3B:
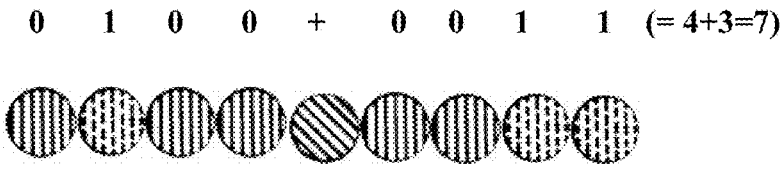

FIGS. 3*a-b* illustrate an example of a "quantum" like way of processing in which electromagnetic waves are interchangeable with binary expressions and represent units of data or operations. In this example an electromagnetic wave of a predetermined wavelength, depicted here in red, is associated with the binary number "0," and another wavelength, depicted in purple, is associated with the binary number "1." Furthermore, one wavelength depicted here in green is associated with the mathematical operation of addition and one wavelength depicted in blue is associated with subtraction. Based on this exemplary association of waves of predetermined wavelengths with binary numbers and mathematical operations, an equation may be "written" and solved using the respective waves as shown in the example from FIG. 3*b*. The point here is that other waves/colors could describe operations (like one of the four basic operations consisting of addition, subtraction, multiplication, or division) on a separate "operation" channel with the benefit being that, depending on how many wavelengths or colors are being used, multiple mathematical and logical operations could be performed in one step (e.g., an addition and a subtraction in a single equation).

Figure 4:
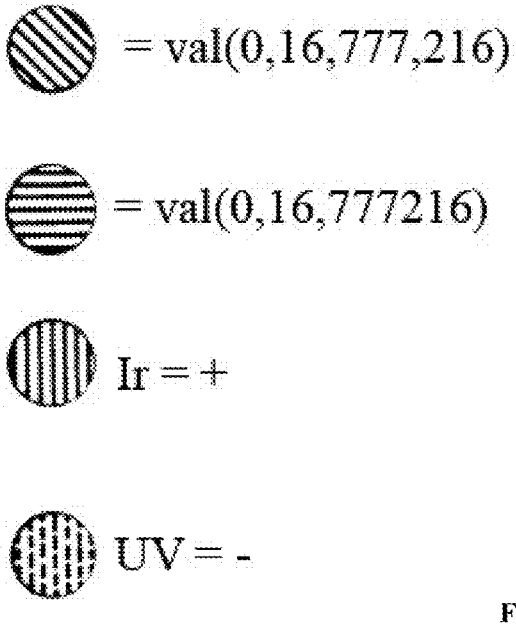
FIG. 4 expands on FIG. 3's principles but instead treats each visible spectrum wavelength as a unit of data and two other electromagnetic wavelengths (infrared and ultraviolet in this example) as the "operation" channels.

FIG. 4 expands on FIG. 3*a*'s principles but instead treats each visible spectrum wavelength (green and blue are shown only) as a unit of data and two other electromagnetic wavelengths (infrared and ultraviolet in this example) as the "operation" channels. This is just an example of an alternate assignment of electromagnetic waves to units of data (e.g., binary numbers; see FIG. 3*a*), mathematical operations (e.g., addition; see FIG. 3*a*), or logical operations (e.g., true or false)). It should be apparent that, the "operation" channels as well as the units of data may be relegated to electromagnetic waves of any wavelengths, whether visible or not. As suggested in FIG. 4, over 16.777 million colors may be available to represent units of data and/or operations when changing the output of each primary color in two hundred and fifty six degrees (i.e., 256×256×256=16,777,216).

Figure 5:
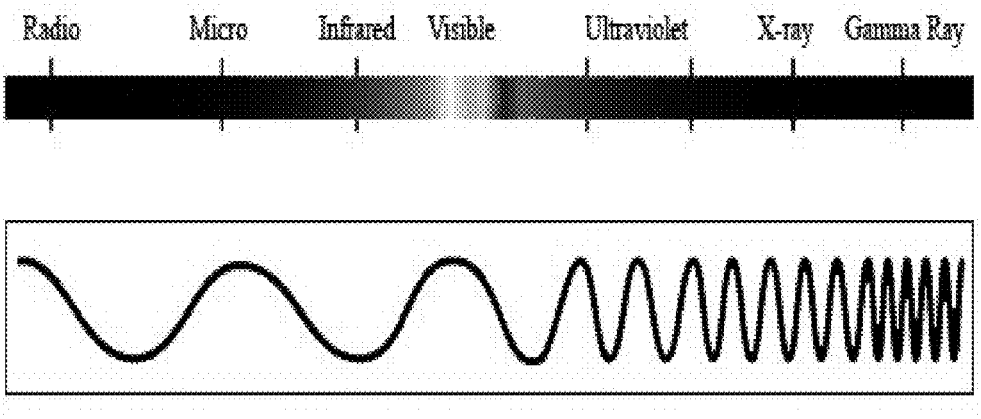
FIG. 5 is a diagram of the electromagnetic spectrum.

FIG. 5 is a diagram of the electromagnetic spectrum. It should be noted that each part of the spectrum is represented by a distinct wave form and wavelength, and thus, different values (e.g., binary numbers, operations, etc) can be assigned to each one of them. Furthermore, by applying to them the control and/or combination techniques described herein, particularly to the waves from the visible spectrum, millions of wavelengths may be obtained.

Figure 6:
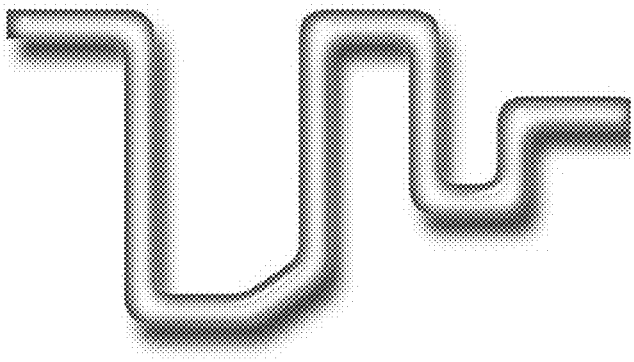
FIG. 6 illustrates and example of "channels" which each wavelength may form when directed through mediums such as fiber optic cables.

FIG. 6 illustrates and example of "channels" which each electromagnetic wave may form when directed through mediums such as fiber optic cables. Other similar mediums, through which electromagnetic waves can travel, may be used to create channels.

Figure 7:
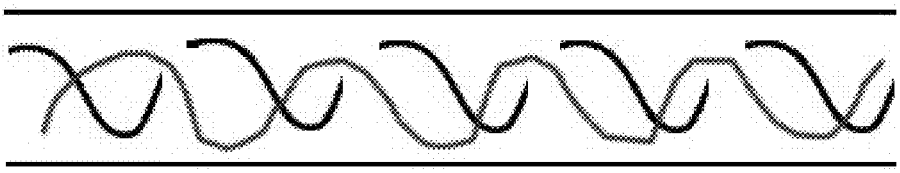
FIG. 7 illustrates two wavelengths which are superimposed upon each other and directed through the same channel.

FIG. 7 illustrates two waves (more may be used), which are superimposed upon each other and directed through the same channel. It should be noted that because they still retain their distinction they can be added or subtracted from each other in order to change values. This is one of the techniques that may be used to perform mathematical or logical operations using waves.

Figure 8A:
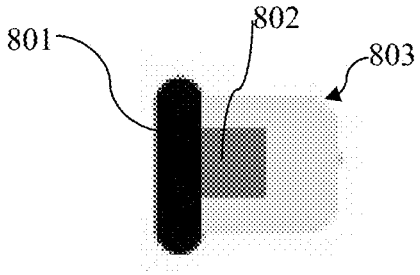
FIG. 8-*a* depicts an electromagnetic emitter in its most common form: a diode.
Figure 8B:
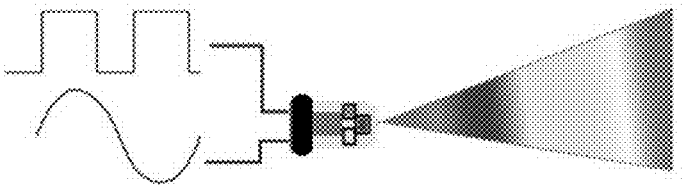

FIG. 8-*a* depicts an electromagnetic emitter in its most common form: a diode. The depicted diode comprises a base 801, a die 802 and a lens 803. The electromagnetic emitter may have a single die, in which case it will produce a specific frequency of the EMS (i.e., infrared or ultraviolet radiation), or, the electromagnetic emitter may have multiple dies, in which case it will produce multiple and/or different frequencies of the EMS. Both, the single die emitters or the multiple dies emitters may be used to practice the computational method described herein. However, using emitters with multiple dies, in combination with the wave mixing techniques described herein, may be preferred, as it allows describing a multitude of combined electromagnetic waves, and thus, a multitude of assignable values. Thus, more information would be passed per channel as each specific frequency can act as a unit of information. This is most advantageous to the visible spectrum range as millions of colors could be described.

FIG. 8-*b* depicts a RGB LED under the influence of an analog or a digital signal. Thus, in the case of a LED with multiple dies, the influence over each color die accounts for the spectrum of colors possible to be obtained with the respective LED. Naturally, the larger the number of influences and the larger the number of dies, the larger the number of obtainable colors will be.

Figure 9:
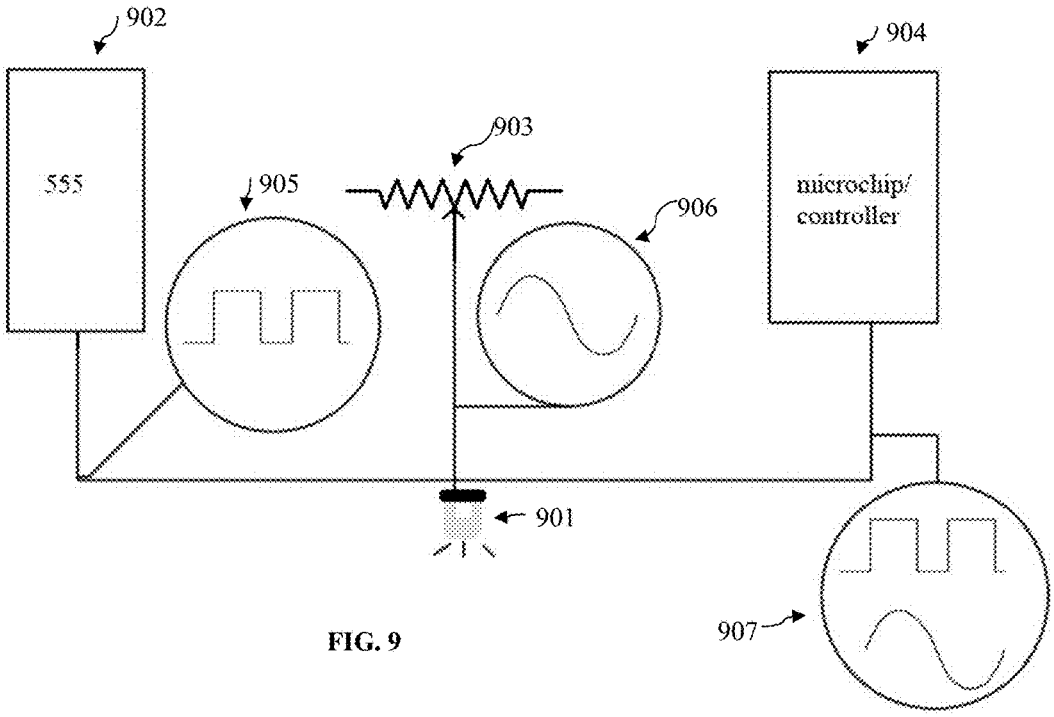
FIG. 9 depicts an exemplary circuit capable of influencing an electromagnetic emitter.

FIG. 9 depicts an exemplary circuit capable of influencing an electromagnetic emitter 901. As shown, the circuit may include a "555" timer 902, potentiometer/variable resistor 903 and a microcontroller/processor 904. Each component manipulates a digital signal 905, an analog signal 906, and both signals 907, respectively. The circuit may control the brightness or influence of the emitter.

Analog and digital control over a wavelength or color can affect its brightness or in other words, how much the color or wavelength influences the final result (i.e., output) of a blended channel. For example, when using a RGB (red, green, blue) emitter as the input and the blended color as the output, analog or digital control would change the amount of red, green or blue, and thus, the color output. In the case of analog control, one would use something like a variable resistor (903 in FIG. 9) to affect the current on a die (i.e., specific wavelength emitter). This technique directly affects brightness or influence by allowing the maximum allotted current to pass through, no current to pass through, or something in between. In the case of digital control, components such as a timer that controls duty cycle (expressed rate of active function aka being "on" over time) emulates brightness or influence by being "on" for longer or shorter duration.

A diffuser 12-*e* may be used to manipulate the output of blended colors. A diffuser 12-*e* is a material that encourages diffusion or the spreading of particles around in a medium until their positions are random and uniform. A diffuser 12-*e* allows for the creation of more colors, other than cyan, magenta, and yellow, when blending the primary red, blue, and green, and the possibility to distinguish the subtle nuances between related colors with minuscule differences in the influence the primary colors exert to make them.

Figure 10:
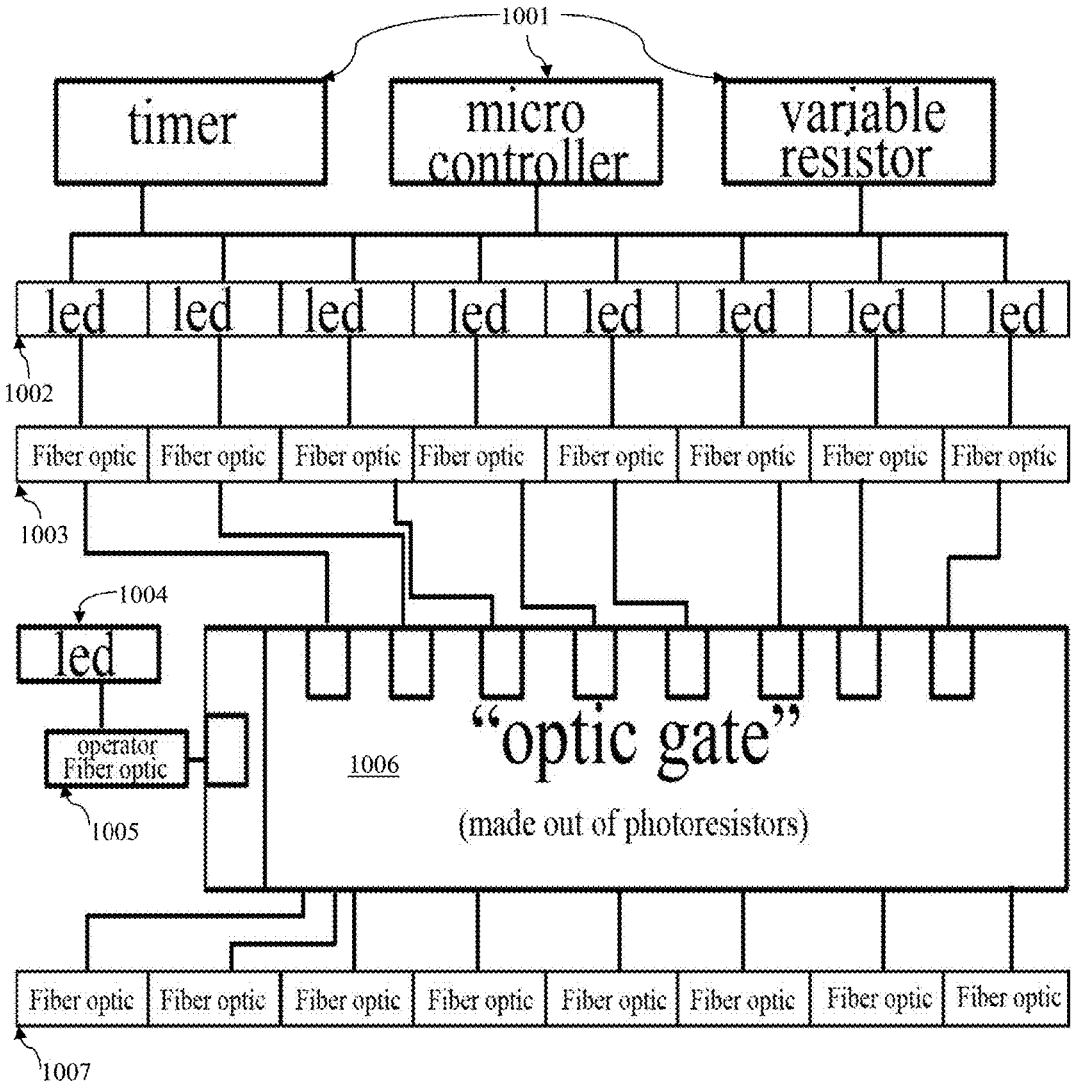
FIG. 10 depicts a diagrammatic view of an exemplary chromatic processor.

FIG. 10 depicts a diagrammatic view of an exemplary chromatic processor. The top part 1001 show a group of components that may be used to influence the wavelength of the color emitted by the LEDs, as earlier described. The components shown are the timer, microcontroller and variable resistor, hereafter referred to as "controls."

The second group 1002 depicts the electromagnetic emitters (LEDs, OLEDs, etc), which may be used to input information. They are what's being acted upon by the "controls." The next group 1003 consists of information input channels or mediums that the electromagnetic waves travel through. As suggested in the diagram, they may be fiber optics.

There may be a separate section with its own emitter(s) 1004 and channel(s) 1005, labeled as the operation channel (s) (one is shown for simplification purposes), which emits and transmits different wavelengths than the primary LEDs 1002 and information input channels 1003. As earlier described, there may be an addition channel, a subtraction channel, and so on, as necessary to perform the desired mathematical and/or logical operations.

Next, FIG. 10 diagram shows an "optical gate" 1006 which is connected to the operational channel(s) 1005, information input channels 1003 and information output channels 1007. The optical gate component 1006 is made out of chambers or rooms, that house photo resistors, LEDs, fiber optics, and mirrors. Using the mirrors and fiber optics, wavelengths are directed through apertures to information output channels 1007 or another LED is activated inside the "optic gate" by the photo resistors. The way the wavelengths are shifted is determined by the photo resistor in the chamber that reads data from the operation channel.

Figure 11:
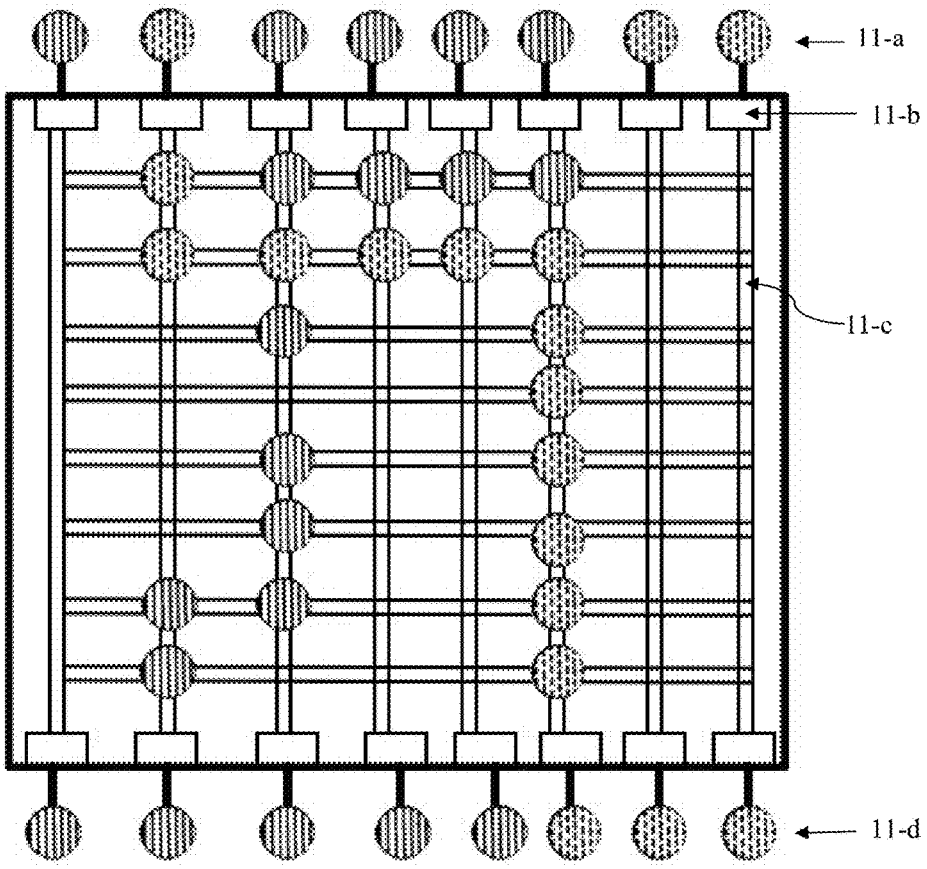
FIG. 11 is a diagrammatic view of an exemplary optical gate.

For example, in the optical gate depicted in FIG. 11, processing is more like the traditional, binary processing. The inputs 11-*a* enter the gate where they reside in "rooms" 11-*b*. These "rooms" contain photodetectors (not shown) which produce an electrical current when stimulated by the photons of a certain wavelength. The operation channel also has its own room, (not shown) and when stimulated, works in conjunction with the photodetectors in the information channels' rooms 11-*b* to guide the waves through the gate, which is arranged inside like a grid system 11-*c*. This is accomplished through the use of a medium of travel (e.g., fiber optics), a reflecting/refracting system (e.g., crystals, mirror, beam splitter) and apertures at the intersections of the grid. In the example shown, the number four (0100) is added to the number three (0011) to make seven (0111 displayed in the example as 0000,0111) by shifting the positions of one of the "ones" and one of the "zeroes," which is then outputted as such 11-*d*.

The limitation comes in when there is not enough, or too many "ones" or "zeroes" to simply shift. An example would be adding one (0001) and three (0011). Since four is (0100) there would be an extra two "one" values. The solution for this is to instead of just shifting, the apertures between the rooms of two of the "one" values and the grid would remain closed as to not even enter the grid. The remaining "one" would shift as usual, and a beam splitter would split a couple of "zero" values into multiple beams which would also be shifted into position, resulting in four (0100).

Figure 12:
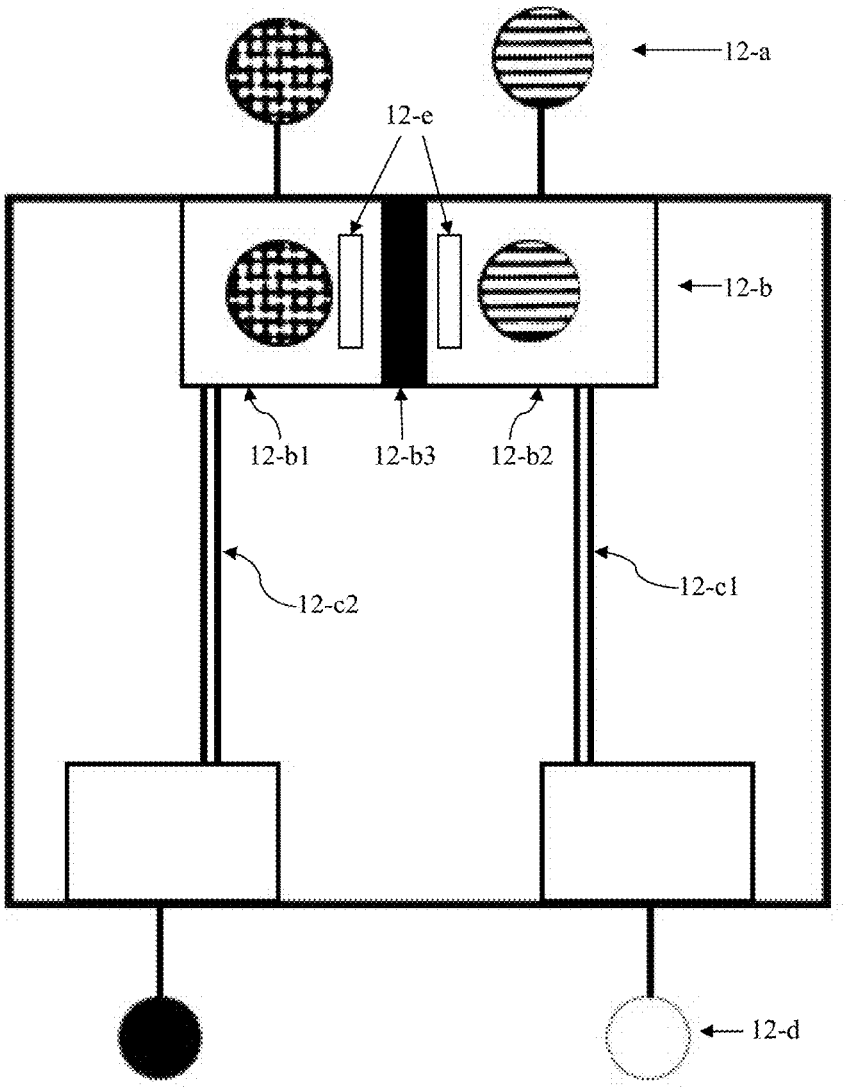
FIG. 12 shows an optical gate where the inputs come from a multiple die RGB LED based system.
Figure 13:
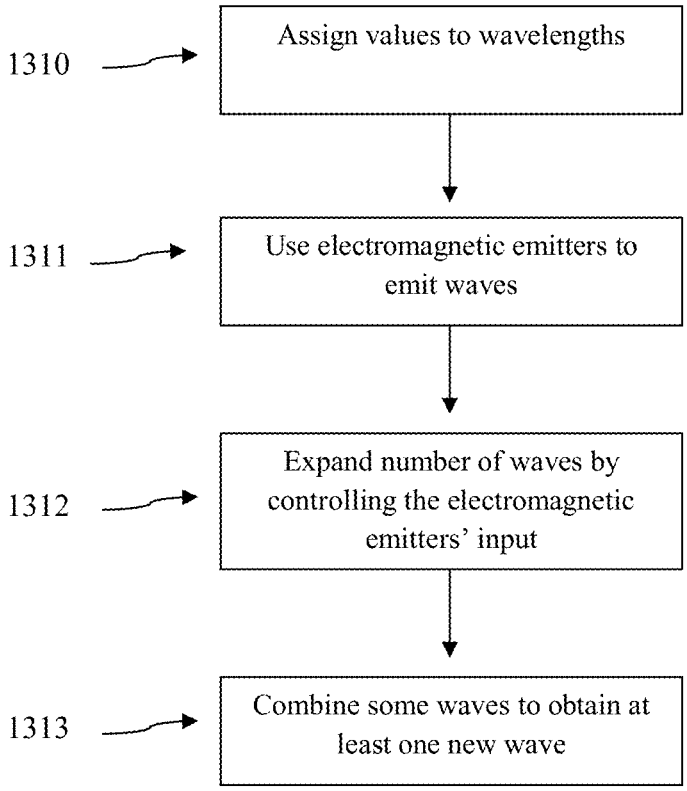
FIG. 13 depicts an exemplary computational process using values assigned to wavelengths.

FIG. 12 shows the inside of an optical gate where the inputs 12-*a* come from a multiple die RGB LED based system. In the illustration, one input channel caries a signal of pure yellow (the highest concentration of red, plus the highest concentration of green), and another carries the signal of pure blue where both signals enter into two different sides of a "room" 12-*b*. The rooms in this system are similar to the rooms in the more "binary" based system (FIG. 11); however, how both systems perform operations (e.g., addition or subtraction) is different due to the components inside.

The rooms in this system consist of two halves (compartments), 12-*b*1 and 12-*b*2, separated by an aperture 12-*b*3. Inside each compartment are three photodetectors (not shown), each attuned specifically to the wavelength of one of the primary colors, but, unlike the rooms in the first optical gate example (FIG. 11), they have a reflecting/refracting system (the optical gate from FIG. 11 also has it but its components are located in the grid system instead) and filters. For an additive statement, (as long as the result did not go over whatever the "value" of white light would be), the information from the operation channel would cause the aperture 12-*b*3 between the two compartments 12-*b*1, 12-*b*2 to open, and the result would be directed through its proper channel as the output. In the example used in FIG. 12, the result adds up to white 12-*d*, and thus, white light was directed through the right channel 12-*c*1.

In cases where the results add up to more than white, the white light beam is ran through a beam splitter (to make two of them) and if necessary, one beam is further changed by running it through the filters and possibly the reflection/refraction system to remove the excess color from the second beam (not needed if white is added to white). In this scenario, the output would be a signal of white on the first (rightmost) channel 12-*c*1 and whatever color is left over after the split and or filtration of the second beam on the next channel(s) 12-*c*2. This example used black (no light) as there was no excess. In a subtraction statement, the wavelength being subtracted from simply gets run through a filter and or reflection/refraction system, and is then directed through the proper channels.

The information output channels 1007 (FIG. 10) may be ultimately in communication with an output device such as a monitor or a printer. The LED group 1002 and/or the information input channels 1007 may be in communication with an input device such as a keyboard.

Again, there are two different constructs of chromatic mainframes corresponding to whether or not the chromatic mainframe is designed in a similar manner to a more traditional electrical based binary systems or one that utilizes multiple dies in a LED that, as earlier described, allows for millions of values to be represented and processed.

It may be advantageous to set forth definitions of certain words and phrases used in this patent document. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Although specific embodiments have been illustrated and described herein for the purpose of disclosing the preferred embodiments, someone of ordinary skills in the art will easily detect alternate embodiments and/or equivalent variations, which may be capable of achieving the same results, and which may be substituted for the specific embodiments illustrated and described herein without departing from the scope of the invention. Therefore, the scope of this application is intended to cover alternate embodiments and/or equivalent variations of the specific embodiments illustrated and/or described herein. Hence, the scope of the invention is defined by the accompanying claims and their equivalents. Furthermore, each and every claim is incorporated as further disclosure into the specification and the claims are embodiment(s) of the invention.

What is claimed is:

1. A computational process configured to perform mathematical or logical operations using a processor having electromagnetic emitters, the computational process comprising:

assigning user-defined mathematical or logical values to wavelength values of at least a portion of the electromagnetic spectrum waves;

using the electromagnetic emitters of the processor for emitting waves having at least some of said wavelength values;

expanding the number of waves available to the computational process by controlling the electromagnetic emitters' input to a blended wave output; and performing a mathematical or logical operation by controllably combining some of the available waves in order to obtain at least one new wave representing at least one new computed mathematical or logical value.

2. A computational process as in claim 1, wherein said user-defined mathematical or logical values comprise binary numbers.

3. A computational process as in claim 1, wherein said user-defined mathematical or logical values comprise mathematical operations.

4. A computational process as in claim 1, wherein said user-defined mathematical or logical values comprise logical operations.

5. A computational process as in claim 1, wherein said portion of the electromagnetic spectrum comprises the visible spectrum.

6. A computational process as in claim 1, wherein the electromagnetic emitters are LEDs having multiple dies.

7. A computational process as in claim 1, wherein the electromagnetic emitters are LEDs having a single die.

8. A computational process as in claim 1, wherein the controlling of the electromagnetic emitters is performed by using digital means.

9. A computational process as in claim 8, wherein said digital means comprise a timer.

10. A computational process as in claim 1, wherein the controlling of the electromagnetic emitters is performed by using analog means.

11. A computational process as in claim 10, wherein said analog means comprise a variable resistor.

12. A computational process as in claim 1, further comprising expanding the number of waves available to the computational process by manipulating the blended wave output through the use of a diffuser.

13. A computational process as in claim 1, wherein said combining is achieved using at least one member of the group consisting of color combining, saturation, red shifting, green shifting, blue shifting, and wave superimposition.

14. A computational process as in claim 1, wherein said combining represents the operation of addition.

15. A computational process as in claim 1, wherein said combining represents the operation of subtraction.

16. A computational process as in claim 15, wherein the new value represents the result of said subtraction.

17. A chromatic processor configured to perform mathematical or logical operations and comprising: at least one input electromagnetic emitter used to input information in the form of electromagnetic waves; means for influencing the emission of said input electromagnetic emitter; at least one input channel, which is in communication with said input electromagnetic emitter and with an optical gate; at least one operation electromagnetic emitter, which, through an operation channel, communicates to said optical gate the operation to be performed by the optical gate; and, at least one output channel through which the result of the operation performed by the optical gate is outputted.

18. A chromatic processor as in claim 17, wherein said optical gate comprises at least one chamber, separated in two compartments by an aperture, wherein, input electromagnetic waves initially reside.

19. An optical gate arranged in a grid like system and comprising: chambers capable of receiving input electromagnetic waves from input channels; optical gate channels which are in communication with said chambers and output channels; means for manipulating the input electromagnetic waves according to the operation to be performed by the optical gate, which results in obtaining output electromagnetic waves; and, means for directing the input and output electromagnetic waves through said optical gate channels.

* * * * *